US006740630B2

(12) United States Patent
Aouad et al.

(10) Patent No.: US 6,740,630 B2
(45) **Date of Patent: *May 25, 2004**

(54) PROCESSES FOR MAKING SUBSTANTIALLY ANHYDROUS STRUCTURED SURFACTANT PASTES AND OTHER DETERGENT INGREDIENTS AND COMPOSITIONS EMPLOYING SAME

(75) Inventors: Yousef Georges Aouad, Cincinnati, OH (US); Christopher John Lienhart, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 40 days.

This patent is subject to a terminal disclaimer.

(21) Appl. No.: 10/198,206

(22) Filed: Jul. 17, 2002

(65) Prior Publication Data

US 2003/0109407 A1 Jun. 12, 2003

Related U.S. Application Data

(60) Provisional application No. 60/307,459, filed on Jul. 24, 2001.

(51) Int. Cl.[7] ..... C11D 17/00

(52) U.S. Cl. ..... 510/404; 510/424; 510/426; 510/499; 510/500

(58) Field of Search ..... 510/404, 424, 510/426, 499, 500

(56) References Cited

U.S. PATENT DOCUMENTS

| | | | |
|---|---|---|---|
| 4,615,820 | A | 10/1986 | Hepworth et al. |
| 4,929,380 | A | 5/1990 | Schulz et al. |
| 4,931,195 | A | 6/1990 | Cao et al. |
| 5,008,031 | A | 4/1991 | Schulz et al. |
| 5,814,596 | A | 9/1998 | Aquad et al. |

FOREIGN PATENT DOCUMENTS

| | | |
|---|---|---|
| EP | 030096 | 6/1981 |
| EP | 565017 | 10/1993 |
| WO | WO 92/09678 | 6/1992 |
| WO | WO 98/00518 | 1/1998 |
| WO | WO 99/29827 | 6/1999 |
| WO | WO 01/09273 A2 | 2/2001 |

*Primary Examiner*—Necholus Ogden
(74) *Attorney, Agent, or Firm*—Kim W. Zerby; Steven W. Miller

(57) ABSTRACT

A process for making substantially anhydrous structured surfactant compositions which, at room temperature, are shear thinning non-Newtonian pastes with a yield point that allows them to be easily worked in commercial apparatus. The process employs alkoxylated cationic structuring agents, anionic surfactants and organic solvents in a drying step to provide the pastes. The pastes are suitable for agglomeration with dry detergent powder to form granular detergent product and are especially suitable for incorporation into anhydrous liquid detergent products.

9 Claims, No Drawings

PROCESSES FOR MAKING SUBSTANTIALLY ANHYDROUS STRUCTURED SURFACTANT PASTES AND OTHER DETERGENT INGREDIENTS AND COMPOSITIONS EMPLOYING SAME

CROSS-REFERENCE TO RELATED APPLICATION

This application claims priority from Provisional Application serial No. 60/307,459. filed Jul. 24, 2001.

FIELD OF THE INVENTION

The present invention relates to processes for making soluble, preferably water-soluble, substantially anhydrous surfactant pastes and other detergent ingredients, products formed by such processes and compositions comprising such substantially anhydrous surfactant pastes and/or other detergent ingredients. More particularly, the present invention relates to a process for making substantially anhydrous surfactant pastes which at room temperature are shear thinning non-Newtonian pastes with a yield point suitable for agglomeration with dry detergent powder to form a granular detergent product and, alternatively, suitable for incorporation into substantially anhydrous liquid products.

BACKGROUND OF THE INVENTION

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Additionally, liquid laundry detergents may have incorporated into their formulations materials which would deteriorate in the drying operations employed in the manufacture of particulate or granular laundry detergent products. Because liquid laundry detergents are usually considered to be more convenient to use than granular laundry detergents, they have found substantial favor with consumers.

Although liquid laundry detergents have a number of advantages over granular laundry detergent products, there are also disadvantages entailed in using them. In particular, laundry detergent composition components which may be compatible with each other in granular products may tend to interact or react with each other in a liquid, and especially in an aqueous liquid environment. Components such as surfactants, perfumes, brighteners and non-aqueous solvents can be especially difficult to incorporate into liquid laundry detergent products with an acceptable degree of compositional stability. Poor compositional stability may cause the detergent composition to deteriorate into an unaesthetic, ineffective, heterogeneous composition during storage.

One approach for enhancing the chemical compatibility and stability of liquid laundry detergent products has been to formulate substantially anhydrous liquid laundry detergent compositions using non-aqueous components. Generally, the chemical stability of the components of a non-aqueous liquid laundry detergent composition increases as the amount of water in the laundry detergent composition decreases. Moreover, by minimizing the amount of water in a liquid laundry detergent composition, one can maximize the surfactant activity of the composition. Non-aqueous liquid laundry detergent compositions have been disclosed in Hepworth et al., U.S. Pat. No. 4,615,820. Issued Oct. 17, 1986; Schultz et al., U.S. Pat. No. 4,929,380. Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992; and Sanderson et al., EP-A-565,017, Published Oct. 13, 1993.

But, non-aqueous liquid laundry detergents come with their own set of disadvantages and problems. The desirable advantage of having excellent compositional stability may also mean that the non-aqueous liquid laundry detergent will have poor solubility and dispersion properties in the wash liquor in an automatic clothes washer. Also, non-aqueous liquids typically have awkward rheological properties, displaying a tendency known as "shear thickening", whereby the viscosity of the paste or liquid increases with an increasing shear rate, making the paste difficult to pump, store and/or transport. Moreover, non-aqueous liquid laundry detergent compositions are difficult and expensive to manufacture. A drying step requiring prolonged heating and stirring is usually necessary to eliminate the water. Not only is it difficult to consistently achieve the proper heating and stirring conditions in a manufacturing setting, but also such drying operations may have the effect of decomposing or evaporating individual components of the detergent composition. The resulting difficulty and expense involved with working with such fluids have greatly reduced their use as laundry detergent compositions.

The incorporation of surfactants into various consumer products, especially detergent products, such as granular detergent products and liquid detergent products, substantially anhydrous liquid detergent products in particular, is a common step in the manufacture of such products. However, the incorporation of such surfactants can present challenges to formulators. especially in the case of substantially anhydrous liquid products, because conventional surfactants, such as alkyl benzene sulfonate surfactants, are typically only available commercially in the form of an aqueous paste prior to being processed into the products.

Given the foregoing, there is clearly a need to provide processes for preparing anhydrous surfactant pastes for incorporation into anhydrous liquid products, as well as into granular detergent products. The resulting liquid and granular products should exhibit a high surfactant activity and should be readily soluble in a wash liquor. In addition, such processes should be easily replicated at multiple production sites and should produce liquid laundry detergent products that can be easily pumped, stored and transported.

The present invention fulfills the needs described above by providing processes for making soluble, preferably water-soluble, substantially anhydrous surfactant pastes and other detergent ingredients, products formed by such processes and compositions comprising such anhydrous surfactant pastes and/or other detergent ingredients.

SUMMARY OF THE INVENTION

The present invention encompasses a process for preparing a substantially anhydrous structured surfactant paste containing less than 5% water, comprising the steps of:

A) forming an aqueous surfactant mixture by mixing, by weight of the mixture:
   (a) from about 5% to about 85%, of an anionic surfactant,
   (b) from about 1% to about 60% of a water-soluble, preferably cationic, structuring agent; and
   (c) from about 15%, to about 95% of an organic solvent,
   wherein the aqueous surfactant mixture has a water content of 5% to about 80% by weight of the aqueous surfactant mixture; and B) drying the aqueous surfactant mixture from step (A) under vacuum, preferably in an evaporative column, to form and structure said substantially anhydrous surfactant paste, which at room temperature (18–30° C.), is in the form of a shear thinning, non-Newtonian fluid.

In a preferred mode the anionic surfactant is selected from the group consisting of alkyl benzene sulfonates, alkyl sulfates, alkyl ethoxy sulfates, and mixtures thereof.

The preferred structuring agent used herein is an alkoxylated cationic compound, especially ethoxylated hexamethylene diamine diquats. The weight ratio of structuring agent: anionic surfactant is preferably in the range of about 1:100 to about 1:1.

In a preferred mode, the organic solvent is a member selected from the group consisting of: alkylene glycols; diethyl- and dipropylene glycol monobutyl ethers; glycol monobutyl ether; monoethylethers, monomethylethers, monopropylethers and monobutylethers of propoxy propanol; polyethylene glycols having a molecular weight of at least about 150; methyl acetate; methyl propionate; methyl octanoate; methyl dodecanoate; and mixtures thereof.

In one aspect, said aqueous surfactant mixture further comprises a nonionic surfactant typically at a weight ratio of anionic:nonionic surfactant in the range of 5:1 to 1:5. In another aspect, the aqueous surfactant mixture further comprises from about 0.001% to about 40% of additional detergency additives selected from the group comprising chelants, buffers, builders and thereof.

In another aspect, the invention encompasses a process for preparing detergent agglomerates comprising the step of admixing the substantially anhydrous detergent paste made in the foregoing manner with a powdered detergent ingredient.

In yet another aspect, the invention encompasses a non-aqueous liquid detergent composition, comprising a surfactant component which is a dried, substantially anhydrous surfactant paste prepared in the present manner, together with a non-aqueous solvent. The surfactant component comprises a mixture of anionic surfactant, preferably by a nonionic surfactant and a structuring agent, and is substantially anhydrous. Preferably, said surfactant paste comprises a member selected from the group consisting of alkyl benzene sulfonate surfactants, alkyl sulfate surfactants, alkyl ethoxy sulfate surfactants, and mixtures thereof. Preferably, said non-aqueous solvent is butoxy propoxy propanol.

DETAILED DESCRIPTION OF THE INVENTION

The present invention provides an efficient process for preparing substantially anhydrous detergent pastes using commercially available feedstocks which comprise about 20% to about 60% anionic surfactants and up to about 80%, more typically about 30%-40%, water. The process herein can be conducted using otherwise conventional evaporation equipment, but preferably employs an agitated thin film evaporator, as disclosed more fully, hereinafter.

Aqueous, high active (78%) surfactant pastes exhibit a rheology which allows them to be readily agglomerated with powered detergent ingredients. Unfortunately, the rheology of many substantially anhydrous surfactant pastes is Newtonian and such pastes do not lend themselves to agglomeration. By the present invention, substantially anhydrous, non-aqueous surfactant pastes which normally would exhibit Newtonian behavior can be produced according to the same methods, but in the presence of a structuring agent, so that the resulting non-Newtonian rheology of the structured paste lends itself to agglomeration.

The present invention solves the aforesaid problems by the use of structuring agents, as disclosed more fully hereinafter.

In one aspect, the present invention provides a process for making soluble, substantially anhydrous surfactant paste, wherein said process comprises 1) mixing a high active aqueous surfactant mixture with a solvent, and 2) evaporating the water from the mixture formed in 1) in the presence of a structuring agent, such as Ethoxylated Hexamethylene Di-amine Di-Quats ("EHDQ") to form a substantially anhydrous surfactant paste.

In another aspect of the present invention, a substantially anhydrous surfactant paste made by the process of the present invention is provided.

In yet another aspect of the present invention, a process for drying (removing water from) detergent ingredients, especially polymers and/or surfactants, more especially surfactants for use in detergent compositions, is provided. Such a process preferably comprises the steps of forming an aqueous detergent ingredient mixture and drying said mixture using an Agitated Thin Film Evaporator (ATFE).

A further aspect of the present invention is to provide a process for preparing substantially anhydrous agglomerates, preferably comprising, surfactants, other detergent adjunct ingredients and/or combinations thereof, wherein the process comprises the step of producing a binder, preferably a substantially anhydrous binder, which is preferably a highly viscous, non-Newtonian solvent based mixture of preferably one or more organic solvents, one or more surfactants, one or more chelants and/or one or more polymers, preferably substantially anhydrous polymers. In a preferred embodiment, the substantially anhydrous binder is formed by mixing an aqueous surfactant paste, such as an anionic material, preferably an anionic surfactant, more preferably linear alkylbenzene sulfonate, with a structuring agent, preferably a cationic material, more preferably a cationic anhydrous polymer, such as Ethoxylated Hexamethylene Di-amine Di-Quats. Preferably, the mixture is made in an aqueous phase in the presence of an organic solvent or carrier and then dried using a drying process described herein, preferably using an Agitated Thin Film Evaporator (ATFE), to produce a substantially anhydrous binder. The anhydrous binder can then be combined with powders, such as citrates, carbonates, silicates, and the like, to torn substantially anhydrous agglomerates. Such a process provides substantially anhydrous agglomerates that do not require a further drying step after the agglomeration step. Such agglomerates are useful in product forms including, but not limited to, liquid detergent products, especially substantially anhydrous liquid detergent products, in powder detergent products, and in detergent tablet products.

Thus the compositions and/or products produced according to the processes of the present invention afford the above benefits which are novel to non-aqueous compositions and yet these processes produce compositions that are typical of a non-aqueous liquid laundry detergent composition, viz. a high surfactant activity and excellent additive stability.

The present invention offers the advantage of providing a substantially anhydrous surfactant paste with only a trace amount of water typically from about 0.02% to less than about 5% by weight of the paste of water (more preferably less than about 3%, most preferably less than about 1% by weight of the paste of water) and yet can incorporate many of the ingredients desirable for use in a laundry detergent composition such as bleach, bleach activators, builders, enzymes, whiteners and other additives. By minimizing the amount of water in the surfactant pastes or mixtures, one may maximize the activity of the surfactant paste.

All percentages, ratios and proportions herein are by weight, unless otherwise specified. All documents cited are, in relevant part, incorporated herein by reference; however, such citation is not to be construed as an admission that the document is a reference against the present application.

Definitions—As used herein, a "Newtonian fluid" is a fluid or paste whose viscosity, within a range of specified shear rates at a specified temperature, has a substantially constant value.

As used herein, a "non-Newtonian fluid" refers to a fluid or paste which cannot be characterized as a "Newtonian fluid."

As used herein, "non-aqueous" or "substantially anhydrous" are used synonymously and both describe a material in which the water content is less than 5%, especially less than about 1%, preferably about 0% to about 0.9%.

As used herein, "structuring" refers to a conditioning of the aqueous anionic surfactant mixture by changing its rheological characteristics by: a) increasing its apparent viscosity; b) imparting a yield point to it, thereby making it more easily pumpable, and/or increasing its ability to work as binder in agglomeration, and/or allowing it to be used in the formation of free flowing agglomerates requiring no drying, all as disclosed, hereinafter.

As used herein, "molecular weight" of various polymers means weight average molecular weight.

Processes

The present invention describes a process for making a substantially anhydrous paste and/or subsequent agglomerate which can be used in preparing granular and/or non-aqueous liquid laundry detergents with various additives. The process comprises the steps of: 1) forming an aqueous surfactant mixture in the presence of a solvent, 2) followed by structuring the mixture during drying under vacuum in the presence of a structuring agent to form a substantially anhydrous surfactant paste. The anhydrous surfactant paste can then be agglomerated with suitable dry detergent powders to yield a soluble, free flowing detergent agglomerate requiring no drying. Alternatively, the anhydrous surfactant paste may be incorporated into a substantially anhydrous liquid detergent.

The processes of preparing non-aqueous liquid laundry detergent compositions with additives has many important parameters and incorporates many different ingredients and additives as well as numerous other preferable and optional process subparts which are described hereafter.

In one embodiment of the present invention a process for making a water-soluble, free flowing, substantially anhydrous surfactant paste comprises the steps of: 1) preparing a mixture of an aqueous surfactant paste and an organic solvent. 2) mixing said mixture with an effective amount, preferably less than 60%, more preferably less than 50%, most preferably less than 30%, typically about 1% to about 20%, by weight of the total mixture, of a chemical structuring agent, and 3) drying the resulting mixture under vacuum in an Agitated Thin Film Evaporator (ATFE) to yield a substantially anhydrous thick paste characterized at room temperature as a shear thinning non-Newtonian paste with a yield point, said yield point preferably being below about 300 Pa (Pascals) at room temperature. The paste can be granulated with a dry detergent powder to form granular detergent products. Alternatively, the surfactant paste can be incorporated into liquid products, especially substantially anhydrous liquid detergent products.

Preferably, the substantially anhydrous surfactant paste of the present invention is comprised of at least one anionic surfactant, and any other surfactants, if present, are selected from the group of anionic, non-ionic, zwitterionic, ampholytic and cationic surfactants and mixtures thereof. The process of the present invention is particularly applicable to alkyl benzene sulfonate (LAS) surfactants, such as NaLAS, especially all neutralized NaLAS aqueous pastes. It may also be used with a wide variety of other surfactants. In a preferred process, said chemical structuring agent is added in a continuous process.

In a preferred embodiment of this invention, the structuring agent is introduced prior to drying so that aqueous surfactant paste conditioning takes place upon removal of the water in the Agitated Thin Film Evaporator. Structuring of the paste is quite dramatic, as evidenced from the change in the rheological characteristics of the paste from Newtonian if dried in the absence of the structuring agent to shear thinning non-Newtonian with a yield point if dried in the presence of the structuring agent. This change in the rheology is enough to allow the use of the structured paste for producing anhydrous agglomerates.

a. Forming the Aqueous Surfactant Mixture

In one aspect, the process herein can be conducted batchwise. For example, the selected ingredients are placed in a mixer with an impeller stirrer to form an aqueous surfactant-containing mixture. It is preferable that each of the ingredients be added in the form of a neutralized aqueous solution which is comprised of about 20% water.

The first ingredient in this step is an aqueous surfactant. The final aqueous surfactant mixture will include, by weight, from about 5% to about 85%, more preferably from about 25% to about 75%, most preferably from about 40% to about 60% of anionic sulfated or sulfonated surfactant. Suitable anionic surfactants are discussed in greater detail below.

The second ingredient is an organic solvent. The final aqueous surfactant mixture will include, by weight, from about 15% to about 95%, more preferably from about 30% to about 70%, most preferably from about 40% to about 60% of an organic solvent. Suitable organic solvents are discussed in greater detail below.

A third ingredient in the formation step is a structuring agent. The aqueous surfactant mixture will include, by weight, less than 60%, more preferably less than 50%, most preferably less than 40%, typically 1% to about 20%, of a structuring agent. Suitable structuring agents are discussed in greater detail below.

A fourth ingredient which can be added in this step is optionally, but preferably a chelant. The final aqueous surfactant mixture will include, by weight, when present, from about 0.001% to about 40%, more preferably from about 0.01% to about 4%, most preferably from about 0.1% to about 2% of a chelant. Suitable chelants are discussed in greater detail below.

Other ingredients, such as optional detergent additives, may be added in the formation step such as buffers, builders, enzymes, nonionic surfactants, whiteners, rheology modifiers, polymers and copolymers. These are discussed in greater detail below.

The aqueous surfactant mixture used in the formation step preferably contains less than 60%, more preferably less than 50% and most preferably less than 30%, typically 5–20%, water. The aqueous surfactant-containing mixture is formed by mixing together all of the ingredients (in any order) into a substantially uniform mixture, at a temperature of between about 25° C. and about 80° C., preferably at a temperature of between about 35° C. and about 70° C. and most preferably at a temperature of between about 45° C. and about 60° C. If the temperature is too low, it will be difficult to process the mixture and if the temperature is too high for a long period of time, degradation of some of the components of the mixture may take place.

The mixing in the formation step is most preferably carried out in a standard mixer or crutcher. The speed of the mixer and the duration of the mixing step varies depend on the type of mixer and ingredients used. Mixing should be done at a speed and for a time sufficient to achieve a homogenous aqueous surfactant mixture.

The process of the present invention which produces anhydrous surfactant pastes can also be practiced in a second aspect, which is continuous. In the neutralization step of this aspect a neutralized surfactant mixture is formed by a continuous neutralization loop. An aqueous surfactant paste, preferably an acid form of an anionic sulfated or sulfonated surfactant, a neutralization base, the organic solvent, the structuring agent, and optionally other detergent additives, preferably a chelant, are continuously added to the neutralization loop. A mixture of the ingredients is formed as the ingredients and mixture are circulated by means of conventional mixers, pumps and heat circulators. Neutralization takes place as the base reacts with the acid form of the surfactant to produce the surfactant in salt form. The resulting neutralized mixture typically has a water content of about 10%–50%.

A first portion of the neutralized mixture can be recirculated in the continuous neutralization loop while a second portion is pumped from the continuous neutralization loop. If desired, additional organic solvent, structuring agent and/or chelant may be added to and mixed with the second portion of the neutralized mixture, e.g., using a static mixer, with the resulting mixture typically having a water content of from about 5% to about 50%, by weight. The resulting mixture is then further mixed in a static mixer and, depending on the needs of the formulator, additional chelant, structuring agent and/or organic solvent may again be added to the resulting mixture and again mixed in a static mixer or a conventional mixer such as a crutcher. Upon completion of mixing the ingredients, the final neutralized mixture can then be pumped to a drying process.

The molar ratio of the acid form of the anionic surfactant to the base is from about 1:1 to about 9:1. It is preferable that these ingredients be added in the form of liquids. The various liquid components which are added to the continuous neutralization loop will preferably have the following amounts of water:

| | |
|---|---|
| acid form of sulfated or sulfonated surfactant | less than 10.0% |
| neutralization base | from about 30% to about 90% |
| organic solvent | less than 2% |
| structuring agent* | from about 0.1% to about 50% |

*When the structuring agent is EHDQ, the aqueous solution preferably comprises less than about 5%, typically 0.9%–4.5%, of the solution of EHDQ.

Suitable neutralization bases for use in this process may be any base which adequately neutralizes the acid form of the surfactant. Such neutralization bases include, but are not limited to, alkali metal carbonates, alkali metal hydroxides and alkali metal phosphates, e.g., sodium carbonate, sodium hydroxide, and sodium polyphosphate.

Drying and Structuring the Aqueous Surfactant Mixture

The aqueous surfactant mixture is then pumped into a drying device where the drying step takes place. The drying step of the process is drying the aqueous surfactant mixture under vacuum to form a substantially anhydrous surfactant paste, typically containing from about 0.02% to less than 5% by weight of the paste of water, more preferably less than about 3%, most preferably less than about 1% by weight of water. This drying may be accomplished in any conventional evaporator, provided that the drying is performed under vacuum. Drying temperatures of 90° C.–200° C. are typical. Suitable evaporators are illustrated in Perry's Chemical Engineering Handbook, 7th. Ed., 1997. McGraw-Hill, ppg. 11–108 to 11–111, "Evaporator Types and Applications". A preferred evaporator is a steam jacketed Agitated Thin-Film Evaporator (ATFE).

The ATFE is operated under vacuum, preferably at about 25–400 mmHg, more preferably at about 75–300 mmHg, and most preferably at 100–200 mmHg. The ATFE jacket temperature is operated preferably at about 100–200 deg C. more preferably at about 120–180 deg C., and most preferably at about 130–170 deg C.

The drying step also produces a combination of water vapor and other volatiles which are subsequently condensed. Those skilled in the art can manipulate the operating conditions of the ATFE i.e. temperature and pressure along with inlet feed rate and residence time in the ATFE to affect the level of water in the dried material and the level of organic matter in the condensed stream.

The drying step produces a substantially anhydrous surfactant which is a non-Newtonian paste having a yield point at 30° C. below about 300 Pa (Pascals).

The process described herein may also be combined with other known detergent-manufacturing process step commonly used in the detergent industry for the manufacture of liquid or solid detergents in any form (e.g. granular, tablet etc.).

Granular Deterrent Product

The substantially anhydrous surfactant paste of the present invention may be agglomerated with dry detergent powder ingredients to form soluble free flowing granular detergent products.

Powder Stream

Although a preferred embodiment of the process of the present invention involves introduction of the substantially anhydrous surfactant pastes (which comprises surfactants, solvents, structuring agents, etc.) into granular detergent products, it is possible to introduce other surfactants via the powder stream, for example in the form of blown powder or agglomerates from another process when forming the granular detergent product during the agglomeration step. The liquid stream of a preferred agglomeration process can also be used to introduce other surfactants or polymers.

Agglomeration Step

The term "agglomeration," as used herein, means mixing and/or granulation of the above mixture of paste and powder in a fine dispersion mixer at a blade tip speed of from about 5 m/sec. to about 50 m/sec., unless otherwise specified. The total residence time of the mixing and granulation process is preferably in the order of from 0.1 to 10 minutes, more preferably 0.1–5 and most preferably 0.2–4 minutes. The more preferred mixing and granulation tip speeds are about 10–45 m/sec. and about 15–40 m/sec.

Any apparatus, plants or units suitable for the processing of surfactants can be used for carrying out the overall process according to the invention. Suitable apparatus includes, for example, standard falling film sulfonating reactors, digestion tanks, esterification reactors, etc. For mixing/agglomeration, any of a number of mixers/agglomerators can be used. In one preferred embodiment, the process of the invention is continuously carried out. Especially preferred are mixers of the Fukae® FS-G series manufactured by Fukae Powtech Kogyo Co., Japan. This apparatus is essentially in the form of a bowl-shaped vessel accessible via a top port and provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the agglomeration step of the invention include Diosna® V series ex Dierks & Sohne, Germany; and the Pharma Matrix® ex T K Fielder Ltd., England. Other mixers suitable for use are the Fuji® VG-C series ex Fuji Sangyo Co., Japan, and the Roto® ex Zanchetta & Co srl, Italy.

Other preferred suitable equipment can include: Eirich®, series RV, manufactured by Gustau Eirich Hardheim, Germany; Lodige®, series FM for batch mixing, series Baud KM for continuous mixing/agglomeration, manufactured by Lodige Maschinenbau GmbH, Paderborn Germany; Drais® T160 series, manufactured by Drais Werke GmbH, Mannheim Germany; and Winkworth® RT 25 series, manufactured by Winkworth Machinery Ltd., Bershire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is useful. The invention can be practiced as a batch or a continuous process.

Operating Temperature

Preferred operating temperatures for the agglomeration step should be as low as possible since this leads to better yield of agglomerates with desired surfactant concentrations in the finished particle. Preferably, the temperature during agglomeration is less than 100° C. more preferably below 80° C. and most preferably below 60° C. typically 15° C.–50° C. Methods for controlling the temperature may be achieved by various methods known in the art including, but not limited to, the use of liquid nitrogen, solid $CO_2$, or the use of jacketed equipment such as chilled barrels of extruders to cool the paste down prior to agglomeration.

Drying of Agglomerates

Since the surfactant paste is substantially anhydrous, typically containing less than about 1% water, the moisture content of the free flowing agglomerates of this invention is influenced mainly by the moisture content of the powders used in agglomeration. For detergent applications, the final moisture of the agglomerates needs to be maintained below levels at which the agglomerates can be stored and transported in bulk. Typical moisture content of powders used for agglomeration such as fine sodium carbonate, fine sodium citrate, zeolites, and the like is such that the moisture content of the final agglomerate will be in the acceptable range of 1–8% free moisture (i.e. water not associated to any crystalline species in the agglomerate) thus requiring no drying step.

Preparation of Non-aqueous Liquid Detergent Products

The anhydrous surfactant paste of the present invention may be incorporated into substantially anhydrous (less than 5% water) non-aqueous liquid detergent products along with other detergent ingredients. Such non-aqueous liquid detergent products typically contain a liquid phase and a solid phase. The liquid phase typically comprises a nonionic surfactant and a non-aqueous, low-polarity organic solvent. The solid phase typically contains one or more particulate materials, such as bleaching agents.

The nonaqueous liquid detergent compositions herein can be prepared by combining the essential and optional components thereof in any convenient order and by mixing, e.g. agitating, the resulting component combination to form the phase stable compositions herein. In a preferred process for preparing such compositions, essential and certain preferred optional components will be combined in a particular order. Such a process is described in detail in U.S. Pat. No. 5,872,092 to Kong-Chan et al.

In such a preferred preparation process, a liquid matrix is formed containing at least a major proportion, and preferably substantially all, of the liquid components, e.g., an alcohol ethoxylate nonionic surfactant and the nonaqueous, low-polarity organic solvent, with the liquid components being thoroughly admixed by imparting shear agitation to this liquid combination. For example, rapid stirring with a mechanical stirrer may usefully be employed.

While shear agitation is maintained, essentially all of the $C_{11}$–$C_{13}$ alkyl benzene sulfonate or alkyl sulfate anionic surfactant, e.g., sodium lauryl sulfate, can be added in the form of a paste, or as particles ranging in size from about 0.2 to 1.000 microns. After addition of the surfactant, particles of an alkalinity source, e.g., sodium carbonate, can be added while continuing to maintain this admixture of composition components under shear agitation. Other solid form optional ingredients can be added to the composition at this point. Agitation of the mixture is continued, and if necessary, can be increased at this point to form a uniform dispersion of insoluble solid phase particulates within the liquid phase. After some or all of the optional solid materials have been added to this agitated mixture, the particulate materials can be added to the composition, again while the mixture is maintained under shear agitation.

As a variation of the non-aqueous liquid composition preparation procedure hereinbefore described, one or more of the solid components may be added to the agitated mixture as a slurry of particles premixed with a minor portion of one or more of the liquid components.

Thus, a premix of a small fraction of a nonionic surfactant and/or nonaqueous, low-polarity solvent with particles of the anionic surfactant and/or the particles of the alkalinity source and/or particles of a bleach activator may be separately formed and added as a slurry to the agitated mixture of composition components.

INGREDIENTS

Anionic Sulfated And Sulfonated Surfactants

Anionic sulfated and/or sulfonated surfactants are employed in the processes described herein in the form of aqueous liquids. Suitable anionic sulfonated surfactants include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13. abbreviated as $C_{11}$–$C_{13}$ LAS.

Further anionic surfactants herein are the sodium alkyl glyceryl ether sulfonates, especially those ethers of higher alcohols derived from tallow and coconut oil; sodium coconut oil fatty acid monoglyceride sulfonates.

Other useful anionic surfactants herein include the water-soluble salts of esters of alpha-sulfonated fatty acids containing from about 6 to about 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of-olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

Particularly preferred surfactants herein include: linear alkyl benzene sulfonates containing from about 11 to 14 carbon atoms in the alkyl group; tallow alkyl sulfates; coconutalkyl glyceryl ether sulfonates; olefin or paraffin sulfonates containing from about 14 to 16 carbon atoms; $C_{10}$–$C_{16}$ alkyl ethoxy (3–15) sulfates; and $C_{10}$–$C_{18}$ alkyl sulfates; and mixtures thereof. Nonionic surfactants include the $C_{10}$–$C_{18}$ ethoxylated (3–15) alcohols.

Non-surfactant Non-aqueous Organic Solvents

The liquid phase of the detergent mixtures and finished detergent compositions herein comprises one or more non-surfactant, non-aqueous organic solvents. The detergent compositions of the present invention will contain from about 15% to about 95%, more preferably from about 30% to about 70%, most preferably from about 40% to about 60% of an organic solvent. Such non-surfactant non-aqueous liquids are preferably those of low polarity. For purposes of this invention, "low-polarity" liquids are those which have little, if any, tendency to dissolve the preferred types of particulate material used in the finished compositions herein, i.e., peroxygen bleaching agents such as sodium perborate or sodium percarbonate. Thus, relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the trade-names Dowanol, Carbitol, and Cellosolve.

Another preferred type of non-aqueous, low-polarity organic solvent useful herein comprises the lower molecular weight polyethylene glycols (PEGs) Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components. e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a liquid phase, most preferably from about 20% to 50% by weight, of a liquid phase of the finished composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

Non-aqueous Surfactants or Surfactant Additive Ingredients that Function as Organic Solvents and/or Co-solvents These non-aqueous surfactants can easily be identified as belonging to non-ionic surfactant the such as alkyl ethoxylates noted above, glycerine, hydrogenated triglycerides, ethoxylated glycerides, glyceryl esters, alkanolamides. Other surfactants include but are not limited to amine-neutralized sulfated or sulfonated surfactants.

Chemical Structuring Agents

Various chemicals structuring agents, when added to the aqueous surfactant mixture prior to drying in the present process to form the substantially anhydrous surfactant paste herein, result in a desirable modification of the rheological characteristics of the substantially anhydrous surfactant paste and/or mixture thereof with a (co)solvent and/or (co)carrier. In particular, the substantially anhydrous pastes made herein are characterized by a yield value of less than 300 Pa. typically in the range of 200–300 Pa. at 30° C. These structuring agents used to achieve these results may he in solid, liquid, or solution form, depending on their specific chemical properties. Examples of agents useful in the present invention include, but are not limited to, amines, ethoxylated amines, quaternized amines, and ethoxylated quaternized amines. The agents above can be used independently or in combination with each other, in accordance with their compatibility.

Non-limiting examples of amines useful herein include primary, secondary and tertiary $C_1$–C alkyl amities and their quaternized derivatives. Water-soluble quats such as the $C_4$–$C_{18}$ alkyl trimethyl ammonium halides are also useful.

More preferred herein for use as the structuring agent are the quaternized polyamines, especially the alkoxylated, quaternized polyamines. Thus, polyamines such as ethylene diamine, diethylene triamine, triethylene tetraamine, and the like, can be alkoxylated (e.g., ethoxylated, propoxylated, butoxylated; preferably ethoxylated) and quaternized on one or, preferably at least two, of the nitrogen atoms, to yield highly preferred, water-soluble structuring agents for use herein. The quaternization can be accomplished in standard fashion, e.g., using a $C_1$–$C_{15}$, preferably $C_1$–$C_3$, alkyl halide, especially alkyl bromides. A highly preferred structuring agent is Ethoxylated Hexamethylene Di-amine Di-quat (EHDQ), which is available commercially from various suppliers.

Other Optional Detergent Additives

In addition to the preferred ingredients described above, the present surfactant mixture and/or pastes of the present invention and/or finished detergent compositions formed with such surfactant pastes can, and preferably will, contain various other optional detergent additives. Such optional detergent additives are typically added to the detergent compositions in the form of dilute aqueous solutions.

Chelants

The surfactant mixtures and/or pastes and/or compositions of the present invention herein may optionally also contain a chelant which serves to chelate metal ions, e.g., iron and/or manganese. Preferably the detergent products made with the anhydrous surfactant paste of the present invention will contain from about 0.1% to about 10%, more preferably from about 0.5% to about 5%, most preferably from about 1% to about 3% of a chelant. Such chelating agents thus serve to form complexes with metal impurities in the composition which would otherwise tend to deactivate composition components such as the peroxygen bleaching agent. Useful chelating agents can include amino carboxylates, phosphonates, polyfunctionally-substituted aromatic chelating agents and mixtures thereof. Other suitable chelants are disclosed in U.S. Pat. No. 5,712,242. issued Jan. 27, 1998, to Aouad et al.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching.

Organic Detergent Builders

Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the SOKALAN™ which have molecular weight ranging from about 5,000 to 100,000.

Another suitable type of organic builder comprises the water-soluble salts of higher fatty acids. i.e. "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the additional particulate material, insoluble organic detergent builders can generally comprise from about 2% to 20% by weight of the compositions herein. More preferably, such builder material can comprise from about 4% to 10% by weight of the composition.

Inorganic Detergent Builders

Such optional inorganic builders can include, for example, aluminosilicates such as zeolites. Aluminosilicate zeolites such as zeolite A, and their use as detergent builders are more fully discussed in Corkill et al., U.S. Pat. No. 4,605,509, issued Aug. 12, 1986. Also, crystalline layered silicates, such as those discussed in this '509 U.S. patent, are also suitable for use in the detergent compositions herein. If utilized, optional inorganic detergent builders can comprise from about 2% to 15% by weight of the compositions herein.

Polymers and/or Co-polymers

The polymers and copolymers used in the present invention may be chosen from a wide range of organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates, polyaspartates, polyvinylpyrrolidones and various copolymers, such as those of maleic and acrylic acids. Molecular weights for such polymers vary widely but most are within the range of 2,000 to 100,000.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Most preferred for use in the present invention are copolymers of maleic and acrylic acid having a molecular weight of from about 2000 to about 100,000, carboxymethyl cellulose and mixtures thereof. The concentration of the aqueous solutions of the polymer or copolymer is not critical in the present invention. However, it is convenient to use solutions which are readily available commercially. Aqueous solutions having a concentration of from 5% to 60% of the polymer or copolymer are suitable.

Optional Brighteners, Suds Suppressors, and/or Dyes

Conventional brighteners, suds suppressors, bleach, bleach activators, bleach catalysts, dyes and/or perfume materials may be incorporated into the surfactant mixtures and/or pastes and/or detergent products of the present invention. Such ingredients must, of course, be compatible and non-reactive with the other composition components in a non-aqueous environment. If present, brighteners, suds suppressors, dyes and/or perfumes will typically comprise from about 0.0001% to about 2% by weight of the compositions herein. Suitable bleach catalysts include the manganese based complexes disclosed in U.S. Pat. Nos. 5,246,621, 5,244,594, 5,114,606 and 5,114,611. Ethoxylated quat clay softeners can also be used.

The following examples are illustrative of the present invention, but are not meant to limit or otherwise define its scope. All parts, percentages and ratios used herein are expressed as percent weight of the composition, unless otherwise specified. In all examples, Karl Fischer analysis is used to determine amount of residual water. A rotational rheometer, Cari-med, supplied by TA Instruments, Delaware. USA is used to measure rheology. Gas Chromatography is used to determine amount of organic content in condensed vapors.

EXAMPLE 1

This process is comprised of two key steps. In the first step raw materials in form of aqueous solutions are combined at a typical batch size of 2400 lb. In the second step, the water is removed from the aqueous feedstock. In the first step, which is a mixing step which can be conducted at room temperature, n-butoxy propoxy propanol (BPP) at a minimum purity of 99% is added to a 50% active aqueous solution of the sodium salt of linear alkyl benzene sulfonate (LAS). The mixture is mixed until it appears homogeneous. Next, a 99% minimum purity Ethoxylated Hexamethylene Di-amine Di-Quat (EHDQ) liquid is added at room temperature, and the resulting mixture is mixed until it appears homogeneous. The formula details are summarized below.

TABLE 1

Composition of Surfactant Mixture

| Component | LAS Solution | BPP | EHDQ |
|---|---|---|---|
| Activity of Aqueous Solution (%) | 50 | 100 | 100 |
| Amount on Dry Basis (%) | 50 | 33.33 | 16.67 |

The water is removed from the aqueous mixture in a 5.4 $ft^2$ steam-jacketed Agitated Thin Film Evaporator (ATFE). The aqueous solution is pumped at a rate of about 82 kg/hr to the evaporator, operating at a temperature of about 158° C. and a pressure of about 100 mm Hg. The product exits the evaporator at a temperature of about 127° C. with a moisture content of about 0.4%. The product is then cooled in a plate and frame heat exchanger to about 35° C. The condensed vapors exiting the ATFE contain about 7% BPP with the balance being water. The dried product further may comprise linear alkyl benzene (LAB) alcohol, which is left over from the sulphonation reaction which produces HLAS $Na_2SO_4$ is a by-product of the reaction between HLAS and NaOH which produces NaLAS. At room temperature, the dried material behaves as a shear thinning non-Newtonian paste with a yield point less than about 300 Pa.

EXAMPLE 2

This process is comprised of two key steps. In the first step, raw materials in the form of aqueous solutions are mixed at a typical batch size of 2400 lb. In the second step, the water is removed from the aqueous feedstock. In the mixing step, at room temperature, n-butoxy propoxy propanol (BPP) at a minimum purity of 99% is added to a 50% active aqueous solution of the sodium salt of linear alkyl benzene sulfonate (LAS). The solution is mixed until it appears homogeneous. Next, a 36.25% active aqueous solution of the sodium salt of [S, S]—ethylenediamino—N—N'—disuccinic acid (NaEDDS) chelant is added, and the resulting solution is mixed until it appears homogeneous. The NaEDDS chelant is added to the other two components at room temperature, and contains a minimum of 99% S,S isomer of the total NaEDDS isomers and a minimum of 95% S,S isomer of the total amino acid species. Next, a 99% minimum purity EHDQ liquid is added at room temperature, and the resulting mixture is mixed until it appears homogeneous. The formula details are summarized below.

TABLE 2

Composition of Aqueous Solutions

| Component | LAS Solution | BPP | NaEDDS Solution | EHDQ |
|---|---|---|---|---|
| Activity of Aqueous Solution (%) | 50 | 100 | 36.25 | 100 |
| Amount on Dry Basis (%) | 53.33 | 35.56 | 5.33 | 5.78 |

The water is removed from the aqueous mixture in a 5.4 $ft^2$ steam-jacketed agitated thin film evaporator. The aqueous solution is pumped at a rate of 69.5 kg/hr to the evaporator, operating at a temperature of 157° C. and a pressure of 97 mm Hg. The product exits the evaporator at a temperature of 121° C. with a moisture content of 0.39%. The condensed vapors exiting the ATFE contain about 7% BPP with the balance being water. LAB and $Na_2SO_4$ are present in the dried product in minor amounts. At room temperature, the dried material behaves as a shear thinning non-Newtonian paste with a yield point less than about 300 Pa.

EXAMPLE 3

This process is comprised of two key steps. In the first step raw materials in form of aqueous solutions are combined at a typical batch size of 2400 lb. In the second step, the water is removed from the aqueous feed stock. In the mixing step, at room temperature, n-butoxy propoxy propanol (BPP) at a minimum purity of 99% is added to a 50% active aqueous solution of the sodium salt of linear alkyl benzene sulfonate (LAS). The solution is mixed until it appears homogeneous. Next, a 36.25% active aqueous solution of the sodium salt of [S, S]—ethylenediamino—N—N'—disuccinic acid (NaEDDS) chelant is added, and the resulting solution is mixed until it appears homogeneous. The NaEDDS chelant is added to the other two components at room temperature, and contains a minimum of 99% S,S isomer of the total NaEDDS isomers and a minimum of 95% S,S isomer of the total amino acid species. Next, 99% pure non-ionic surfactant NEODOL™ C23–C25 is added at room temperature followed with a 99% minimum purity EHDQ liquid at room temperature, and the resulting mixture is mixed until it appears homogeneous. The formula details are summarized below.

TABLE 2

Composition of Aqueous Solutions

| Component | LAS Solution | BPP | NaEDDS Solution | EHDQ | Neodol C23–25 |
|---|---|---|---|---|---|
| Activity of Aqueous Solution (%) | 50 | 100 | 36.25 | 100 | 100 |
| Amount on Dry Basis (%) | 36.92 | 24.62 | 3.69 | 4.0 | 30.77 |

The water is removed from the aqueous mixture in a 5.4 $ft^2$ steam-jacketed agitated thin film evaporator. The aqueous solution is pumped at a rate of 69.5 kg/hr to the evaporator, operating at a temperature of 157° C. and a pressure of 97 mm Hg. The product exits the evaporator at a temperature of 121° C. with a moisture content of about 0.39%. The condensed vapors exiting the ATFE contain about 7% BPP with the balance being water. At room temperature, the dried material behaves as a shear thinning non-Newtonian paste.

EXAMPLES 4–5

In the following Examples 4 –5, $C_{11}$–$C_{13}$ alkylbenzene is sulfated to provide linear alkyl benzene sulfonate, acid form ("HLAS") having a completeness and acid value of 97 and 172.14, respectively. The HLAS is neutralized in a continuous neutralization system such as a neutralization loop available from the Chemithon Corporation, Seattle, Wash. USA in the presence of an organic solvent/carrier as well as a chelant. The mixture exiting the loop is then dried in an agitated thin film evaporator ("ATFE") such as is available from LCI Corporation, Charlotte, N.C., USA.

EXAMPLE 4

The HLAS is neutralized with a 50% solution of NaOH while co-adding the n-butoxy propoxy propanol ("n-BPP1") produced by the Dow Chemical of Midland, Mich. and a 37% solution of the sodium salt of [S,S]—ethylenediamino—N—N'—disuccinic acid ("NaEDDS") After neutralization the resulting mixture comprises, on a weight basis:

| Ingredient | Amount (%) |
|---|---|
| NaLAS | 46.8 |
| BPP | 31.44 |
| NaEDDS | 4.5 |
| Water | 16 |
| Miscellaneous Minors | Balance |

The combined flow rate of all components into the neutralization loop at room temperature is 1.034 kg/min The temperature of neutralization is 99° F. (37.2° C.) while the temperature of the mixture exiting the loop is 95° F. (35° C.) 99% minimum purity EHDQ is then added to the mixture and mixed until homogeneous. The mixture is then fed continuously at a rate of 95 kg/hr into a 5.4ft$^2$ ATFE) operating at 160° C. and 95 mmHg. The resulting dry material contains 0.6% water and behaves as a shear thinning non-Newtonian paste with a yield point. The composition is as follows:

TABLE 4

Composition of Aqueous Solutions

| Component | LAS Solution | BPP | NaEDDS Solution | EHDQ |
|---|---|---|---|---|
| Activity of Aqueous Solution (%) | 50 | 100 | 36.25 | 100 |
| Amount on Dry Basis (%) | 53.33 | 35.56 | 5.33 | 5.78 |

EXAMPLE 5

HLAS is neutralized with 50% solution of NaOH while co-adding n-BPP. After neutralization the resulting mixture comprises, on a weight basis:

| Ingredient | Amount (%) |
|---|---|
| NaLAS | 34.8 |
| BPP | 54.2 |
| NaEDDS | 1.16 |
| Water | 7.8 |
| Miscellaneous Minors | Balance |

The combined flow rate of all components into the neutralization loop at room temperature is 2400 kg/hr The temperature of neutralization is 99° F. (37.2° C.) while the temperature of the mixture exiting the loop is 95° F. (35° C.). A portion of this material is then mixed with EHDQ. The resulting mixture is then fed continuously at a rate of 117 kg/hr into a 5.4ft$^2$ ATFE operating at 160° C. and 95 mmHg. The resulting material contains 0.96% water and behaves as a shear thinning non-Newtonian paste with a yield point.

TABLE 5

Composition of Aqueous Solutions

| Component | LAS Solution | BPP | NaEDDS Solution | EHDQ |
|---|---|---|---|---|
| Activity of Aqueous Solution (%) | 50 | 100 | 36.25 | 100 |
| Amount on Dry Basis (%) | 53.33 | 35.56 | 5.33 | 5.78 |

It is to be appreciated that the structured nature of the non-Newtonian pastes of the present invention is readily visualized when the pastes herein are compared with the syrupy ("honey"-consistency) of prior art detergent concentrates. The pastes herein are used to prepare agglomerates, as demonstrated in the following Examples.

EXAMPLES 6–10 Agglomerates

EXAMPLE 6

This example describes a process in batch mode in a pilot plant scale high shear mixer an (Eirich RV02). The mixer is filled first with any detergent ingredient powders (typical particle size range 1–500 nm) to be used, in this particular case, sodium carbonate. The binder for making the agglomerates is the pasty material made in Example 1. One kilogram of paste is added to 3 kg of light free flowing dry sodium carbonate. The mixer is operated until granulation takes place. The process is then stopped and the agglomerates are collected. No drying of agglomerates is needed.

EXAMPLE 7

Agglomerates are made using the same equipment in Example 6. The mixer is filled first with a mixture of powders, in this particular case, a 2:1 ratio of zeolite to fine carbonate. The binder for making the agglomerates is the pasty material made in Example 2. One kilogram of paste is added to 3kg of the powders. The mixer is operated until granulation takes place. The process is then stopped and the agglomerates are collected. No drying of agglomerates is needed.

EXAMPLE 8

Agglomerates are made using the same equipment in Example 6. The mixer is filled first with a mixture of powders, in this particular case, a 2:1 ratio of zeolite to fine citrate. The binder for making the agglomerates is the pasty material made in Example 5. One kilogram of paste is added to 3 kg of the powders. The mixer is operated until granulation takes place. The process is then stopped and the agglomerates are collected. No drying of agglomerates is needed.

EXAMPLE 9

Agglomerates are made using the same equipment in Example 6. The mixer is filled first with a mixture of powders, in this particular case, a 3:1 ratio of fine carbonate to fine citrate. The binder for making the agglomerates is the pasty material made in Example 5. One kilogram of paste is added to 3 kg of the powders. The mixer is operated until granulation takes place. The process is then stopped and the agglomerates are collected. No drying of agglomerates is needed.

EXAMPLE 10

Agglomerates made in Example 8 can be added as a component so as to achieve the following overall composition of a non-aqueous liquid detergent prepared in accordance with the invention, which uses BPP as a carrier fluid.

| Component | Wt % |
|---|---|
| Na LAS | 15.33 |
| Nonionic Surfactant[1] | 20.4 |
| n-BPP | 17.55 |
| Hydrotrope[2] | 4.74 |
| NaCiratc dihydrate | 3.66 |
| Phosphonate[3] | 2.85 |
| $Na_3EDDS$ | 1.15 |
| Ethoxylated Quaternized amine clay material | 1.23 |
| Na Perborate | 11.38 |
| Bleach Activator | 5.69 |
| NaCarbonate | 9.49 |
| Protrease | 0.81 |
| Amylase | 0.76 |
| Carezyme | 0.03 |
| Q-Cell 300 microspheres | 0.95 |
| Silicone antifoam | 1.02 |
| fatty acid[4] | 0.47 |
| $TiO_2$ | 0.47 |
| Brightener | 0.19 |
| PEG 8000 | 0.38 |
| Sodium Sulfate | 0.43 |
| $H_2O$ | 0.20 |
| Miscellaneous up to 100% | 0.82 |
| TOTAL | 100% |

[1]Neodol ™ 23–5
[2]1.4 Cyclo Hexane Di Methanol
[3]diethylenetriaminepenta (methylenephosphonic acid)
[4]sodium salt of hydrogenated C14–C18 fatty acid Having described the present invention in detail with reference to preferred embodiments and Examples, it will be clear to those skilled in the art that various changes and modifications may be made without departing from the scope of the invention, and the invention is not to be considered limited to what is described in the specification

What is claimed is:

1. A process for preparing a substantially anhydrous structured surfactant paste containing less than 5% water, comprising the steps of:

A) forming an aqueous surfactant mixture by mixing, by weight of the mixture:
   (a) from 5% to about 85% of an alkyl benzene sulfonate surfactant;
   (b) from about 1% to about 60% of a water-soluble alkoxylated cationic structuring agent at a weight ration of structuring agent: alkyl benzene sulfonate surfactant in the range of about 1:100 to about 1:1 and
   (c) from about 15% to about 95% of an organic solvent. wherein the aqueous surfactant mixture has a water content of 5% to about 80% by weight of the aqueous surfactant mixture; and B) drying the aqueous surfactant mixture from step (A) under vacuum to form and structure said substantially anhydrous surfactant paste which, at room temperature, is a shear thinning, non-Newtonian fluid.

2. A process according to claim 1, wherein said surfactant paste further comprises an anionic surfactant selected from the group consisting of alkyl sulfates, alkyl ethoxy sulfates, and mixtures thereof.

3. A process according to claim 1, wherein the alkoxylated cationic compound is an ethoxylated hexamethylene diamine diquat compound.

4. A process according to claim 1, wherein the organic solvent is a member selected from the group consisting of: alkylene glycols; diethyl- and dipropylene glycol monobutyl ethers; glycol monobutyl ether; monoethylethers, monomethylethers, monopropylethers and monobutylethers of propoxy propanol; polyethylene glycols having a molecular weight of at least about 150; methyl acetate; methyl propionate; methyl octanoate; methyl dodecanoate; and mixtures thereof.

5. A process according to claim 1, wherein the aqueous surfactant mixture further comprises a nonionic surfactant.

6. A process according to claim 1, wherein the aqueous surfactant mixture further comprises from about 0.001% to about 40% of additional detergency additives selected from the group comprising chelants, buffers, builders, and mixtures thereof.

7. A process for preparing detergent agglomerates, comprising the step of admixing the substantially anhydrous structured detergent paste made according to claim 1 with a powdered detergent ingredient.

8. A non-aqueous liquid detergent composition, comprising:

a) a substantially anhydrous surfactant paste prepared according to claim 1; and b) a non-aqueous solvent.

9. A composition according to claim 8, wherein said non-aqueous solvent is butoxy propoxy propanol.

* * * * *